United States Patent [19]

Kingsford

[11] Patent Number: 4,632,136

[45] Date of Patent: Dec. 30, 1986

[54] MASCARA APPLICATION SYSTEM

[75] Inventor: Ted I. Kingsford, Memphis, Tenn.

[73] Assignee: Plough, Inc., Memphis, Tenn.

[21] Appl. No.: 548,062

[22] Filed: Nov. 2, 1983

[51] Int. Cl.[4] ..... A45D 40/26

[52] U.S. Cl. ..... 132/88.7; 132/7

[58] Field of Search ..... 132/88.5, 88.7, 11 A, 132/85; 401/128; 15/159 A

[56] References Cited

U.S. PATENT DOCUMENTS 3,084,374 4/1963 Ziegler ..... 132/88.7

3,921,650 11/1975 Montgomery ..... 132/88.7

4,175,574 11/1979 Zulberti ..... 132/88.7

4,326,314 4/1982 Moret ..... 132/11 A

*Primary Examiner*—Gregory E. McNeill

*Attorney, Agent, or Firm*—Gerald S. Rosen; Stephen I. Miller

[57] ABSTRACT

A mascara application system features a mascara fluent having a viscosity range from 1,500 to 25,000 poises at ambient temperature; and a brush applicator having from 100 to 150 bristle strands per quarter inch of material, with a denier of approximately 0.003 to 0.004 inches. This system separates and combs the eyelashes as it simultaneously applies the mascara in an even and uniform manner.

7 Claims, 1 Drawing Figure

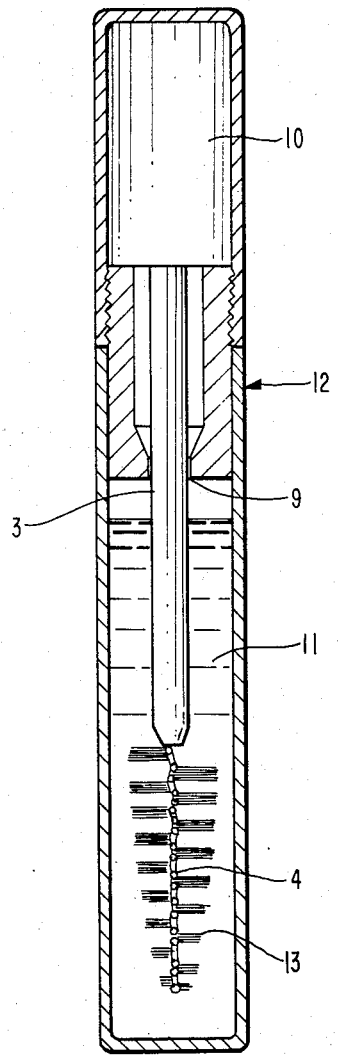
10
12
9
3
11
4
13

MASCARA APPLICATION SYSTEM

FIELD OF THE INVENTION

The present invention pertains to a mascara application system capable of uniformly and evenly applying mascara to eyelashes. Clumping and excess mascara on the eyelashes is avoided. The eyelashes appear naturally thicker and longer without sticking together.

BACKGROUND OF THE INVENTION

During recent years mascara has become an important make-up accessory. Numerous applicators and application systems have been designed to apply mascara for increasing curl, color and length of the eyelashes. However, some application systems do not properly apply the mascara causing a build-up of excessive amounts of mascara on the lashes. This can cause the lashes to stick together, resulting in an unnatural lash appearance. Quite often the eyelashes are merely pushed back and clumped, they are not combed, uniformly coated or separated. As a result, the user may be required to redistribute the mascara and separate the lashes in order to obtain the desired natural lash appearance.

The present invention provides for a mascara application system which uniformly and evenly applies mascara, while simultaneously separating and combing the eyelashes. The mascara applicator of the present invention employs a brush having relatively fewer bristles. The bristles may also be of a finer denier. A motor can also be provided to assist in the combing and separation of the eyelashes.

The present invention can be more formally stated as a mascara application system for applying fluent mascara, that comprises an elongated shaft having brush and handle portions, and a reservoir for holding a supply of the fluent mascara which is deposited on the brush portion when the brush is dipped therein. The reservoir has an orifice or wiper for metering the mascara deposited on the brush portion. A cooperating cover member which is part of the handle portion removably engages with said reservoir member for closing said orifice opening. The cover can contain a motor operatively connected to the brush for rotating the brush during application of the fluent mascara to the eyelashes. The motorized rotation of the brush assists in applying an even and uniform layer or coating to the lashes. The brush contains between approximately 75 to 150 bristles per quarter inch of bristle material having a denier of about 0.003 to 0.004 inches in diameter. The application system has fluent mascara having a viscosity at ambient temperature in the range of about 1,500 to 25,000 poises. The combination of a brush having finer and fewer bristles and a mascara of given viscosity compatible therewith has been found to allow the eyelashes to be combed and separated as the mascara is applied.

The above combination of system elements is unique not only from a functional standpoint but is not obvious from standard usage. By this, we mean to emphasize that a standard of 199 bristles per quarter inch of brush material has prevailed for the entire industry for the past many years. Why this standard was chosen or why it has continued without change or question is obscure. One reason for a heavy concentration of bristles may be the fact that a viscous mascara fluent would tend to collapse or distort a finer bristle brush, i.e., a brush having either fewer and/or finer bristles.

This invention has derived a system that allows for a combing and separation of the lashes, which function is generally lacking with standard bristle quantities and/or deniers. We have also discovered that viscous mascara fluents at the upper end of the viscosity range, i.e., 25,000 poises, will not deleteriously effect the structural and functional integrity of a finer brush element, but rather will be more efficaciously spread upon the lashes by the finer brush.

BRIEF DESCRIPTION OF THE DRAWING

The FIGURE illustrates an axial cross-sectional view of the entire mascara application system of this invention including an improved motorized applicator.

DETAILED DESCRIPTION OF THE INVENTION

Generally speaking, the present invention features a mascara application system that selectively applies the mascara to the lashes of an eye, while simultaneously combing and separating the lashes to provide a natural lash appearance. The inventive applicator achieves the aforementioned result by means of an applicator brush that has fewer and finer bristle strands in combination with a fluent mascara of a compatible viscosity that allows for even and uniform application to the lashes. When the brush portion of the applicator is dipped into the reservoir or container of fluent mascara, the entire brush portion acquires the mascara. Upon the removal of the brush from the reservoir the brush is caused to rotate by means of a motor optionally built into the handle portion of the applicator brush.

When the eyelashes are coated with mascara from the above-mentioned brush, the bristles will comb and separate the lashes simultaneously while applying the mascara fluent in a uniform and even manner.

A typical helical mascara brush used by most of the industry has 597 strands of 0.004 nylon twisted to a length of approximately ¾" (12 twists±2) or 199 strands per ¼".

It has been found that for a mascara brush and particularly a rotating brush, this density of strands of nylon is too thick or too closely placed together. This, plus the viscosity of the mascara formula (into which the brush is dipped) does not allow the brush to penetrate eyelashes to easily coat and separate them. This combination merely pushes the lashes back as the rotating brush is pressed against them.

It has been discovered that by reducing the number of strands in a brush by approximately 50%, superior mascara application to the lashes and separation of the lashes is achieved. The rotating brush with greater space between strands penetrates the lashes and coats and separates them simultaneously.

The rotating motion of the brush with a lesser density and denier plus the elimination or lessening of the helix angle causes the applicator to:

(a) "Comb through" the lashes;
(b) coat them from all sides;
(c) remove excess mascara; and
(d) causes instant separation of the lashes.

Referring to the cutaway FIGURE, an axial sectional view of a mascara container, 12, is illustrated containing fluent mascara 11, and characterized by the improved applicator brush 13 of the present invention. The applicator shaft 3 is attached to handle 10 at one end and contains an arrowhead-shaped brush 13 at the other end attached via wire 4. Brush 13 contains fewer bristles of finer denier. A conventional wiper element or orifice 9, is included at mouth of the open end of the container 12 to remove a portion of the mascara 11, from the bristles.

The bristles are generally spirally attached along the applicator wire 4 at one end and a handle 10 is attached at an opposite end via shaft 3. A motor can be contained inside the handle 10. The motor rotates shaft 3, and hence brush 13, when the brush is applied to the lashes.

A switch (not shown) disposed on the handle 10 actuates the internal motor, and may be of a pressure sensitive type. Thus, when the handle 10 is squeezed between the fingers, the motor is activated, as when the brush 13 is removed from the reservoir and applied to the lashes.

Typical system parameters for this invention are given in Table 1, below:

TABLE 1

SYSTEM PARAMETERS

Mascara viscosity range 1,500 to 25,000 poises.

| | |
|---|---|
| Length of brush: | ½" to 1" |
| Diameter of brush: | 3/16" to 5/16" |
| Bristles Diameter: | .003 to .004 |
| No. of Bristles: | 150 to 100 strands per ¼" of bristle material (25%–50% less strands) |
| Shape of Brush: | Arrowhead shape |
| Brush material: | Nylon |

Having thus described this inivention, what is desired to be protected by Letters Patent is presented in the following appended claims.

What is claimed is:

1. A mascara application system, comprising:

a reservoir containing mascara fluent having a viscosity at ambient temperature in the range from about 1,500 poises to 25,000 poises; and an applicator for immersion into said mascara fluent having a brush containing approximately 75 to 150 bristle strands per quarter inch of brush material.

2. The mascara application system of claim 1, wherein said bristle strands have a denier of about 0.003 to 0.004 inches in diameter.

3. The mascara application system of claim 1, wherein said brush comprises twisted bristle strands.

4. The mascara application system of claim 1, wherein said mascara fluent has a viscosity of approximately 5,000 poises and an applicator brush having 100–150 bristle strands per quarter inch of brush material.

5. The mascara application system of claim 1, wherein said brush has an approximate length of one-half to one inch.

6. The mascara application system of claim 1, wherein said brush has an approximate diameter of from three-sixteenths to five-sixteenths of an inch.

7. The mascara application system of claim 1, wherein said brush has an arrowhead shape.

* * * * *